US006327341B1

(12) United States Patent
Hoheisel

(10) Patent No.: US 6,327,341 B1
(45) Date of Patent: Dec. 4, 2001

(54) SCATTERED-RAY GRID

(75) Inventor: Martin Hoheisel, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/581,619

(22) PCT Filed: Dec. 16, 1998

(86) PCT No.: PCT/DE98/03701

§ 371 Date: Aug. 11, 2000

§ 102(e) Date: Aug. 11, 2000

(87) PCT Pub. No.: WO99/31674

PCT Pub. Date: Jun. 24, 1999

(30) Foreign Application Priority Data

Dec. 17, 1997 (DE) ..... 197 56 262

(51) Int. Cl.[7] ..... G21K 1/00
(52) U.S. Cl. ..... 378/154
(58) Field of Search ..... 378/154, 155

(56) References Cited

U.S. PATENT DOCUMENTS 4,969,176 * 11/1990 Marinus ..... 378/154
5,416,821 5/1995 Frazier et al. .
5,418,833 5/1995 Logan .
6,047,044 4/2000 Lehmann et al. .

FOREIGN PATENT DOCUMENTS 0 333 276 9/1989 (EP) .
0 603 043 6/1994 (EP) .

OTHER PUBLICATIONS

Patent Abstracts of Japan Publication No. 03267049, for Japanese Application 02064104.

* cited by examiner

*Primary Examiner*—Craig E. Church
(74) *Attorney, Agent, or Firm*—Schiff Hardin & Waite

(57) ABSTRACT

A scattered-ray grid, particularly for medical radiography systems having an X-ray source which emits an X-ray beam with a center ray is formed by a carrier with absorbent elements, namely in the form of lead elements that are realized as separated pins in spaced rows. The rows of pins are oriented such that they proceed toward the intersection of the center ray and the scattered-ray grid.

13 Claims, 3 Drawing Sheets

SCATTERED-RAY GRID

BACKGROUND OF THE INVENTION

1. Field of the Invention

The present invention relates to a scattered-ray grid, particularly for medical radiography systems having an X-ray source that generates an X-ray beam with a center ray, the scattered-ray grid being of the type having a carrier with absorption elements, particularly in the form of lead elements, which are formed as spaced pins in rows which are spaced apart from one another.

2. Description of the Prior Art

In radiography, particularly in medical diagnostics, scattered-ray grids are frequently employed to attenuate the scattered radiation emanating from the examination subject relative to the effective radiation. The grids commonly used today consist of a sequence of lead lamellas which are layered in alternation with lamellas made of a carrier material. X-rays that strike in the layers of the lamellas are attenuated only by the carrier material. Oblique radiation, on the other hand, is more or less absorbed by the lead lamellas.

Since such lead lamellas generate unavoidable lines on the X-ray image, and furthermore the number of lines per centimeter is limited for technical reasons having to do with production, German OS 197 29 596, corresponding to U.S. Pat. No. 6,047,044, discloses using spaced pins made of lead or some other absorptive material instead of the lead lamellas.

Owing to the conical beam geometry of the X-radiation which is common in projection radiography, the lead lamellas—and this applies accordingly to the parallel pins that serve in their stead—must not be oriented in parallel fashion. Rather, they must be directed in such a way that they are all oriented to the focus of the X-ray tube. This requirement means a significant outlay for production. Furthermore, the focusing of the scattered-ray grid is calculated only for a specific interval between focus and grid. When this interval is changed, the orientation conditions are no longer correct for the peripheral radiation, and clearly visible shadowing occurs at the image margins. Previously, the expense for producing focused grids was accepted as unavoidable, and beyond this several grids were employed, which had to be exchanged according to the selected focus-grid interval. But this was a significant disadvantage in terms of both production and handling, which was associated with significant added costs.

European Application 0 333 276 describes a scattered-ray grid for compensating vignetting which is provided with perforations that are arranged circularly, the density of which is not constant over the area.

SUMMARY OF THE INVENTION

An object of the present invention is to provide a scattered-ray grid of the above mentioned type such that it can be produced more easily and can be employed independent of the focus-grid interval.

This object is achieved in accordance with the principles of the present invention in a scattered-ray grid having rows of pins which are respectively oriented so as to proceed toward the point of intersection of the center ray of the X-ray beam with the scattered-ray grid.

A significant advantage of the inventive arrangement, in which the pins or the lamellas made of absorptive material are no longer arranged in parallel rows but instead are arranged radially symmetrically with respect to the center axis of radiation, is the avoidance of the aforementioned focusing problem. In principle lamellas could be used instead of the pin rows, though problems arise in the region of the midpoint in the lamellar arrangement, since the absorptive material there would completely gate out a disk-shaped region on the center axis of the radiation, and the production of radially arranged lamellas in alternation with carrier material would be extremely complicated. Because of the radially symmetrical arrangement of the pin rows, the size of the focus-grid interval is of no significance whatsoever to the permeability of the inventive scattered-ray grid to the actual effective radiation, since in any case the effective radiation can pass unobstructed between two radial absorption rows which are spaced apart from one another in the perimeter.

In order still to obtain a sufficient scattered-ray absorption at a great distance from the center point although the radial rows of radiation-absorbent separated pins are already arranged at very large intervals, additional intermediate rows of pins can be arranged between the rows of pins that extend continuously into the vicinity of the center point, which additional rows commence radially only at a distance from the center point.

What is important is to guarantee that the mean surface coverage of the absorptive pins is as uniform as possible over the entire surface of the scattered-ray grid. This ensures an optimally homogenous transparency for the effective radiation.

Such an arrangement nevertheless has the disadvantage of a symmetry which may become visible later in the imaging process. For this reason, in a more advantageous embodiment of the invention, the intermediate rows of pins are arranged at least partly phase-shifted, whereby the pins of the rows along a radius can be phase-shifted section by section, i.e. approximately offset somewhat to the left or right relative to a ray emanating from the radius. In this way it is possible to prevent disturbance to the imaging due to periodic structures.

A silicon disk, particularly a monocrystalline disk, can serve as the carrier.

To produce an inventive scattered-ray grid, holes can be etched into the carrier using a directionally selective etching method, into which holes the absorptive material is introduced in a liquid or semiliquid state and then cooled, and excess absorptive material is removed following cooling, for instance by polishing ("directionally selective" means a higher etching rate depthwise than laterally). An electrochemical etching method or a plasma etching method can be used, whereby a lithographic etching mask that corresponds to the pin pattern to be generated is placed onto the surface of the carrier prior to the etching and removed again following etching.

DESCRIPTION OF THE PREFERRED EMBODIMENTS

Figure 1:
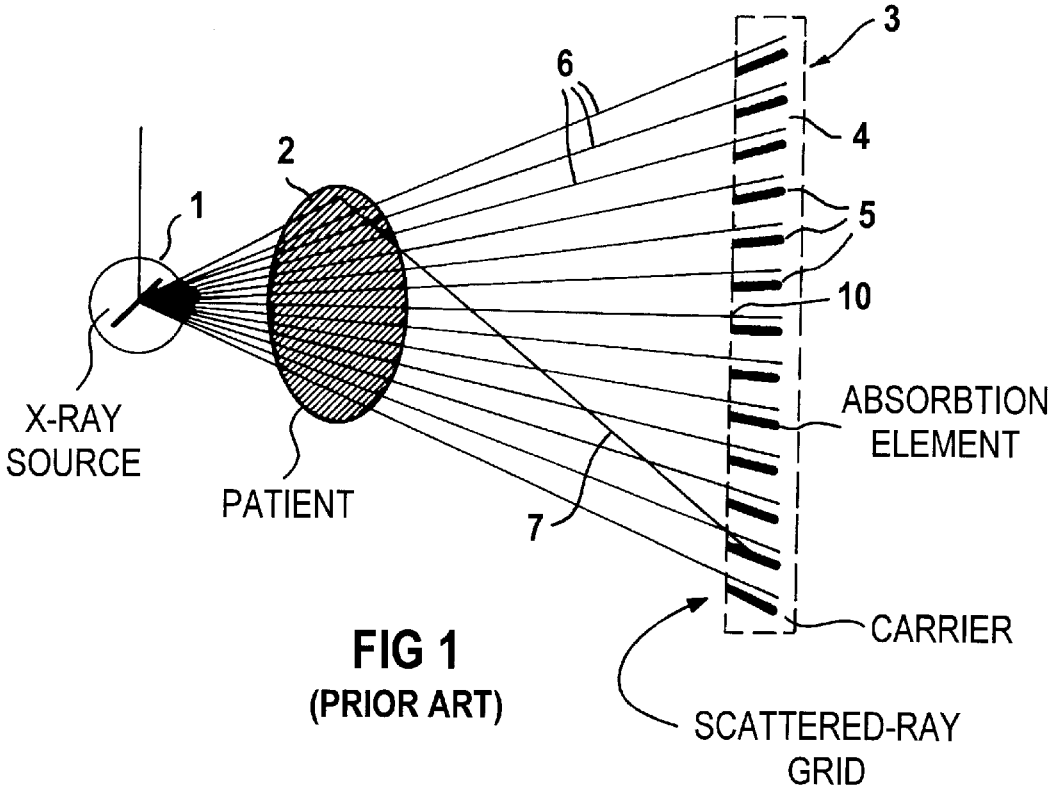
FIG 1 (PRIOR ART)
FIG. 1 is a schematic illustration showing the structure and functioning of a conventional scattered-ray grid with lead lamellas.

FIG. 1 is a schematic illustration of an X-ray source 1 which emits a conical X-ray beam that penetrates an examination subject 2, for instance a human body that is to be diagnosed. FIG. 1 shows a conventional scattered-ray grid 3 which is formed by a number of lead lamellas 5 embedded in a carrier 4. These lead lamellas 5 are oriented such that they all point to the focus of the X-ray tube 1. Perpendicular to the plane of the drawing they extend essentially parallel.

While the effective rays 6 can pass between the lead lamellas and are only slightly attenuated by the material of the carrier 4, oblique scattered rays 7 are more or less absorbed by the lead lamellas 5.

Figure 2:
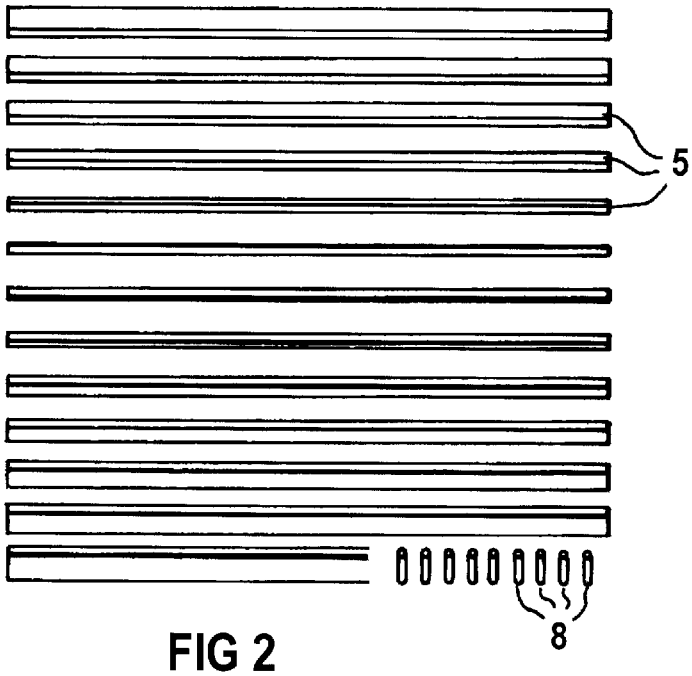
FIG 2 (PRIOR ART)
FIG. 2 is a view of the conventional scattered-ray grid of FIG. 1 as seen in the direction of the incident radiation.

To avoid the production outlay in the lead lamella arrangement it is known, as indicated at the bottom of FIG. 2, to replace the lead lamellas with a plurality of parallel pins, which are formed by etching and subsequent filling of the etched holes. With a directionally selective etching process it is possible to achieve the orientation to the focus of the X-ray tube 1 appreciably more easily than with a layering of lead lamellas.

Despite the simpler process of producing a scattered-ray grid with pins instead of lamellas, the disadvantage nevertheless arises that the scattered-ray grid is always developed optimally for only one prescribed focus-grid interval, and shadowing problems arise for other intervals.

Figure 3:
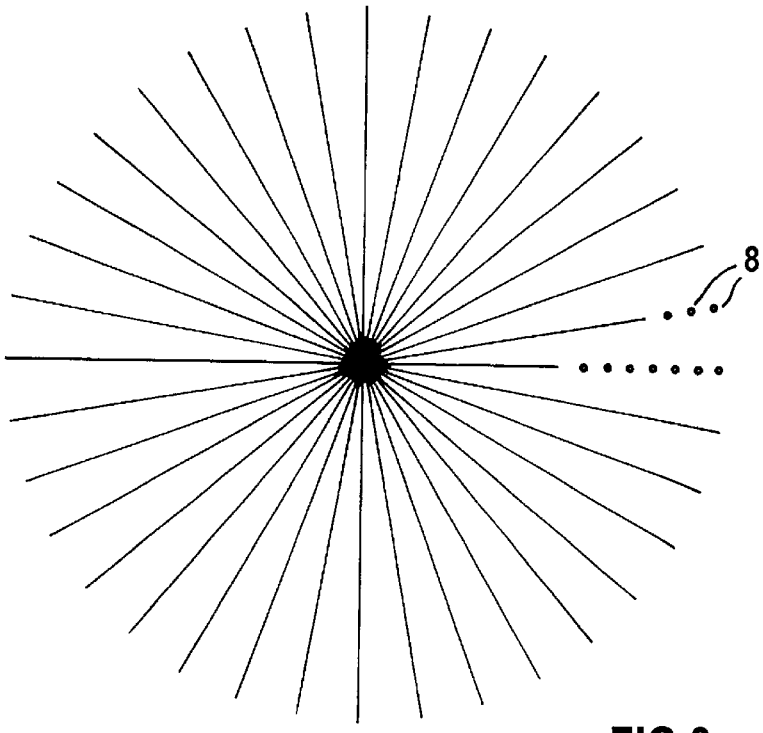
FIG. 3 shows the radially symmetrical structure of an inventive scattered-ray grid.

To avoid this, it is inventively provided that, as shown in FIG. 3, the pins 8 of absorptive material are no longer arranged in essentially parallel rows, but instead are arranged radially symmetrically along rays that emanate from the center point situated on the center axis of the radiation i.e., the point of intersection of the central X-ray with the scattered-ray grid. As in the arrangement in FIG. 2, in the arrangement in FIG. 3 the radiation source is also situated vertically over the plane of projection. It can easily be seen that the effective radiation passing between the absorbent pins which are arranged along radial rays can pass unobstructed, regardless of the distance at which the X-ray source is arranged from the scattered-ray grid 3.

Figure 4:
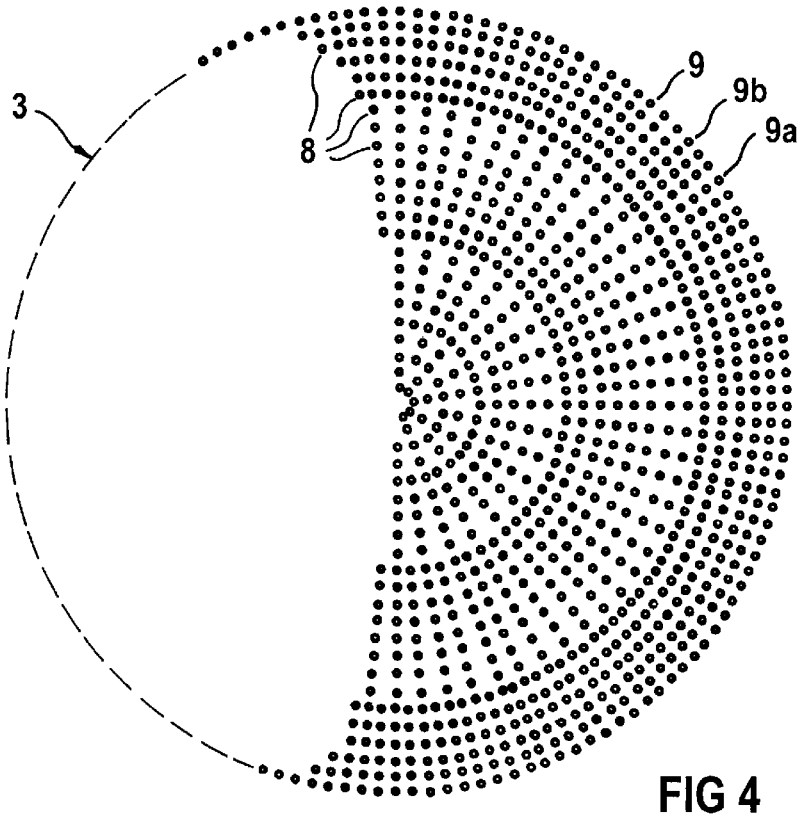
FIG. 4 is a view of a modified version of an inventive scattered ray grid, with intermediate rows of pins disposed between the continuous rows of pins, the intermediate rows beginning at a radial distance from the center of the scattered-ray grid.

FIG. 4 shows a modified embodiment of the simplest inventive scattered-ray grid 3 according to FIG. 3, with intermediate rows of pins 9*a* and 9*b* arranged between respectively radially continuous rows of pins 9 of absorptive material, beginning at a greater distance from the center point, respectively. In this way the entire field of the scattered-ray grid should be covered with pins optimally evenly.

It is advantageous to place the absorbent pins on a small area in the middle of the scattered-ray grid in a regular, for instance hexagonal or cubical, arrangement. The arrangement in radially extending rows occurs only subsequently at some distance from the center point. This guarantees that a homogenous pin density also prevails in the middle, and the transition into the radial rows can ensue in an approximately steady fashion.

Figure 5:
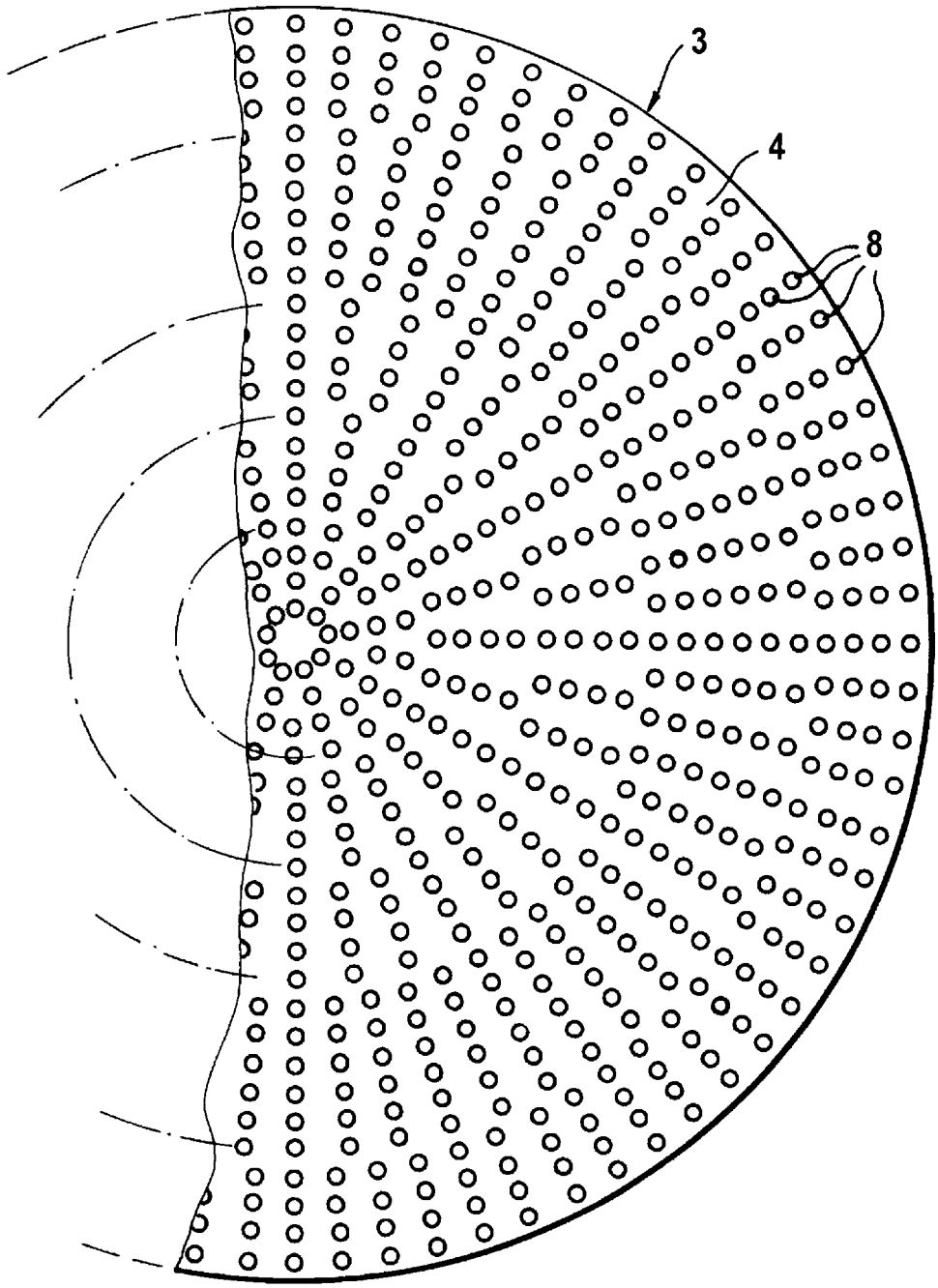
FIG. 5 is a view of a further version of an inventive scattered-ray grid wherein at least some of the intermediate rows of pins are phase-shifted.

To eliminate the symmetries arising here, which could become visible in the imaging, it is provided in the embodiment according to FIG. 5 that practically all rows of pins are split into individual sections along the radius, these sections being phase-shifted somewhat to the left or right with respect to the continuous ray. This eliminates the symmetry, and, given the constant, essentially even filling of the surface with pins, the disturbing imaging of such symmetries in the X-ray image is avoided.

Although modifications and changes may be suggested by those skilled in the art, it is the intention of the inventor to embody within the patent warranted hereon all changes and modifications as reasonably and properly come within the scope of his contribution to the art.

I claim:

1. A scattered-ray grid for use in a medical radiography system having an x-ray source which emits an X-ray beam having a center ray, said scattered-ray grid comprising:

a carrier having a plurality of absorption elements therein disposed in a plurality of spaced apart radially proceeding rows, each absorption element comprising a lead pin and said carrier being intersected by said center ray at an intersection point; and said rows each being oriented to proceed toward said intersection point.

2. A scattered-ray grid as claimed in claim 1 wherein said pins are oriented substantially parallel to each other.

3. A scattered-ray grid as claimed in claim 1 wherein said pins are disposed substantially uniformly over said carrier.

4. A scattered-ray grid as claimed in claim 1 wherein said plurality of absorption elements includes a group of said lead pins in a center region of said carrier disposed at regular intervals which deviate from a radially symmetrical orientation.

5. A scattered-ray grid as claimed in claim 4 wherein said pins in said center region are disposed in a hexagonal spacing.

6. A scattered-ray grid as claimed in claim 4 wherein said pins in said center region are disposed with a quadratic spacing.

7. A scattered-ray grid as claimed in claim 1 wherein pins in at least some of said rows are offset from a radial line proceeding from said intersection point so as to be phase-shifted in sections.

8. A scattered-ray grid as claimed in claim 1 wherein said carrier is comprised of silicon.

9. A scattered-ray grid as claimed in claim 8 wherein said carrier is comprised of a monocrystalline silicon disk.

10. A method for producing a scattered-ray grid for use in a medical radiography system having an X-ray source which emits an X-ray beam having a center ray, said method comprising the steps of:

providing a carrier which will be intersected at an intersection point by said central ray;

producing rows of holes in said carrier by directionally selective etching so that said rows proceed toward said intersection point;

introducing X-ray absorbent material into said holes at least in a semi-liquid state and cooling said x-ray absorbent material; and after cooling said x-ray absorbent material, removing any excess absorbent material from a surface of said carrier.

11. A method as claimed in claim 10 comprising producing said holes in said carrier by electrochemical etching.

12. A method as claimed in claim 10 comprising producing said holes in said carrier by plasma etching.

13. A method as claimed in claim 10 comprising generating a lithographic etching mask having openings therein corresponding to a predetermined pattern of absorbent material and placing said lithographic etching mask on said surface of said carrier prior to etching, and conducting said etching through said lithographic etching mask and removing said lithographic etching mask after said etching.

* * * * *